United States Patent [19]

Mohr

[11] Patent Number: 4,700,558

[45] Date of Patent: Oct. 20, 1987

[54] WIRE COILING METHOD AND DEVICE

[75] Inventor: Henry G. Mohr, Carthage, Mo.

[73] Assignee: Leggett & Platt, Incorporated, Carthage, Mo.

[21] Appl. No.: 850,846

[22] Filed: Apr. 11, 1986

[51] Int. Cl.[4] ..... B21F 3/04

[52] U.S. Cl. ..... 72/145; 72/142; 72/371

[58] Field of Search ..... 72/66, 135, 138, 142, 72/143, 145, 371

[56] References Cited

U.S. PATENT DOCUMENTS

| | | |
|---|---|---|
| 1,843,240 | 2/1932 | Owen . |
| 1,892,501 | 12/1932 | Burd et al. . |
| 2,388,401 | 11/1945 | Freundlich . |
| 2,404,424 | 7/1946 | Balla, Sr. . |
| 2,631,639 | 3/1953 | Palmer . |
| 2,643,698 | 6/1953 | Crooker . |
| 2,705,932 | 4/1955 | Du Bosco De Beaumont . |
| 2,793,672 | 5/1957 | Duff . |
| 2,801,670 | 8/1957 | Wolf . |
| 2,833,329 | 5/1958 | De Poy . |
| 2,927,744 | 3/1960 | Nye et al. . |
| 3,082,810 | 3/1963 | Platt . |
| 3,351,104 | 11/1967 | Kitselman . |
| 3,541,828 | 11/1970 | Norman . |
| 3,779,058 | 12/1973 | Norman . |
| 3,802,241 | 4/1974 | Huhnen . |
| 3,872,702 | 3/1975 | Bittman et al. . |

FOREIGN PATENT DOCUMENTS

| | | |
|---|---|---|
| 2700924 | 7/1978 | Fed. Rep. of Germany . |

*Primary Examiner*—Robert L. Spruill
*Assistant Examiner*—Donald R. Studebaker
*Attorney, Agent, or Firm*—Wood, Herron & Evans

[57] ABSTRACT

A coil-forming apparatus includes three pinch wheels spaced about the periphery of an idler roller rotatably mounted to a platen. Wire is fed through the platen between the pinch wheels and idler roller where the wire is held in place. Rotation of the platen relative to the idler roller imparts a longitudinal twist to the wire, and the pinch wheels drivingly engage the twisted wire with a controlled gripping force and form it into coils against a tapered, forward surface of the idler roller. The coiled wire is then advanced outwardly from the idler roller to a mandrel having an axially adjustable pitch setting roller which engages the coil at a predetermined location from the idler roller to set the wire with the desired pitch.

18 Claims, 7 Drawing Figures

WIRE COILING METHOD AND DEVICE

BACKGROUND OF THE INVENTION

This invention relates to wire coiling devices, and, more particularly, to a device for longitudinally twisting wire and then forming the twisted wire into coils of precise diameter and pitch.

Coil springs, both of the compression and extension type, have been formed in prior art coiling machines by first wrapping a length of wire around a mandrel. The wire is stretched beyond its elastic limit as it is wrapped around the mandrel, so that the outer edge of the coil is longitudinally stretched in tension and the inner edge of the coil is stressed in compression. Once coiled, the wire must then be compressed in length to form a finished pre-stressed compression or extension spring. In many prior art machines it was necessary to form the wire in coils approximately six inches long to obtain a finished spring three inches long. Compression of the originally wound coils also changes the diameter of the coils in the finished spring, and this had to be taken into account in forming coil springs in accordance with such prior art methods.

As discussed in detail in U.S. Pat. No. 3,541,828 to Norman, a disadvantage of coil springs formed by the above-described technique is that the maximum working stress or stiffness of such springs is limited. The limited working stress results from forming the spring by first winding it into a coil and then compressing the coils into a finished spring. It has been found that a greater circumferential prestress can be applied to wire by first longitudinally twisting the wire beyond its elastic limit and then forming the coils, rather than twisting the wire beyond its elastic limit in the formation of coils. The greater the circumferential pre-stress in the wire the greater the stiffness or working strength. In addition, the longitudinal tension stresses applied to the outer surface of the coils formed with the prior art method can lead to surface fractures of the coil and subsequent breakage of the spring.

In the Norman coiling device, the wire is first twisted longitudinally beyond its elastic limit and then formed in a coil of the desired diameter and length. The coils need not be compressed to form the finished spring and therefore do not change in diameter. Additionally, as discussed above, the working stress or stiffness of a spring formed by the Norman coiling device is greater than a spring of the same diameter formed by the prior art method because a greater circumferential pre-stress can be applied to the wire by twisting it before it is formed into a coil.

The Norman coiling device employs a planetary gearing arrangement to form coils from pretwisted wire. A feed wheel mounted on a rotating platen is movable in a planetary motion with respect to the platen. The feed wheel receives the wire from a twisting device which imparts a longitudinal twist to the wire, and the feed wheel then guides the twisted wire to a stationary stanchion having coil-forming rollers mounted thereto. The twisted wire is held by a belt against the feed wheel as it moves from the twisting device to the stanchion for coiling.

One problem with the Norman coiling device has been the formation of coils of non-uniform diameter and/or pitch. This is attributable to the manner in which the twisted wire is held or secured to the feed wheel in moving from the twisting device to the coil-forming rollers on the stanchion. It has been found that the wire slips between the belt and the feed wheel so that the length of wire supplied to the coil-forming rollers can vary. This results in the formation of coils having different diameters. The inability of the belt to secure or clamp the wire against the feed wheel is a particular problem with heavy gauge wire where a substantial force is required to both twist the wire longitudinally and form it in a coil on the stanchion.

One solution to the problem of wire slippage at the point where it is formed into coils is found in German Pat. No. 2,700,924. In this coiling device, three drive rollers each having wire-engaging grooves are spaced approximately 120° apart about the periphery of a mandrel. Wire fed from a reel is clamped between the grooves in the drive rollers and the mandrel to positively grip the wire and avoid slippage. The drive wheels are rotated with respect to the fixed mandrel to bend the wire against the mandrel to form a coil, and then to advance the coils along the mandrel at a controlled rate.

Although the German coiling device solves the wire gripping problem of the Norman apparatus, it has several limitations. The German device produces coils in the same manner as the prior art described above wherein the wire is not twisted prior to the formation of coils. This limits the stiffness or working stresses in the springs produced by the German device, and creates problem of surface fractures in the coils, as discussed above. Additionally, the pitch of the coils is formed in the German device by a machined groove in one of the drive rollers. The pitch cannot be adjusted without removing the drive roller and replacing it with another drive roller machined with a different pitch-forming groove.

SUMMARY OF THE INVENTION

It is therefore among the objects of this invention to provide a coil-forming apparatus which longitudinally twists the wire prior to coiling and then securely grips the twisted wire during the coiling operation and which permits fast and easy adjustment of the pitch of the coils.

These objectives are accomplished in a coil-forming apparatus which includes a rotatable platen, an idler roller mounted at the center of the platen and rotatable relative thereto, and three pinch wheels spaced at equal intervals about the periphery of the idler roller. The pinch wheels are rotatable with the platen in a planetary motion about the idler roller and mounted upon shafts for rotation with respect to the platen. Wire is guided between the pinch wheels and idler roller and twisted along its longitudinal axis by the planetary movement of the platen relative to the idler roller. The twisted wire is then drivingly advanced axially along the idler roller by the pinch wheels and formed into coils along a tapered end of the idler roller. The pinch wheels continue to move the wire, now in the form of coils, axially relative to the idler roller to a mandrel having an adjustable pitch roller for forming the coils with the desired pitch.

More specifically, in one aspect of this invention the wire is first twisted along its longitudinal axis prior to the formation of coils. The structure of the coil-forming apparatus which twists the wire includes the platen which is rotatably mounted upon a fixed frame at the forward end of the coiling apparatus. Wire is paid out from a reel and guided by a series of guide rollers from the rearward portion of the machine to the platen. In a presently preferred embodiment, forward guide rollers located at the forward end of the frame are spaced radially outwardly from the center of the platen where the idler roller is rotatably mounted. The wire is turned radially inwardly from the forward guide rollers to a point between the pinch wheels and idler roller where the wire is positively gripped.

Rotation of the platen relative to the idler roller, which is free wheeling on the platen, imparts a twist to the wire because the wire is held in position against the idler roller as the platen rotates. As discussed above, this circumferential pre-stress applied to the wire is higher than the pre-stress which can be obtained if the wire is pre-stressed as it is coiled. The coils formed by this invention are therefore stiffer or have a higher working stress for the same diameter than can be achieved with such prior art methods.

In another aspect of this invention, each of the pinch wheels are formed with a circumferential groove which aligns with a similarly shaped groove in the idler roller. The wire is received within the grooves of the pinch wheels which drivingly engage the wire and force it against the idler roller to maintain a positive grip or traction on the wire. The pinch wheels each pre-form the wire into the general shape of a finished coil within the grooves formed in the pinch wheels and idler roller. The finished coil having the desired diameter is formed between a tapered extension or sizing wheel mounted upon one of the pinch wheels, and a tapered surface formed at the forward end of the idler roller. The taper on the sizing wheel is chosen to engage the tapered forward end of the idler roller at a predetermined point depending upon the diameter of the coil desired. Different coil diameters may be obtained by replacing the sizing wheel with one of a different taper and/or adjusting the axial position of the tapered sizing wheel with respect to the forward end of the idler roller.

After the coil has been formed against the tapered forward end of the idler roller, the pinch wheels continue to rotate and move the formed coil axially, along the longitudinal axis of the idler roller. In a presently preferred embodiment, a mandrel is co-axially mounted to the idler roller and is formed with a groove adapted to receive a pitch adjustment carriage. The pitch adjustment carriage supports a pitch-forming roller which engages the coils as they move from the idler roller. The axial spacing of the pitch roller from the tapered forward end of the idler roller determines the pitch of the coil, and such pitch may be readily adjusted by moving the pitch adjustment carriage axially within the slot formed in the mandrel.

The diameter of a coil formed at the idler roller is a function of the pitch of a coil. For example, if the pitch is increased, the diameter of the coil will also increase even though a smaller diameter may have been formed in the coil at the tapered forward end of the idler roller. Adjustments in the pitch of the coil, obtained by axial movement of the pitch adjustment carriage along the mandrel, are accommodated by the tapered surface of the sizing wheel of this invention. The wire is permitted to change position along the tapered surface of the sizing wheel relative to the forward end of the idler roller with each change in pitch.

In another aspect of this invention, means are provided for adjusting the radial position of the pinch wheels with respect to the idler roller, and also to vary the pressure or traction applied by the pinch wheels to the wire moving along the mandrel. In a presently preferred embodiment, a locking ring is positioned at the forward end of the machine which is carried by bearing housings at the forward end of the pinch wheel drive shafts. The opposite end of each pinch wheel drive shaft is carried by a spherical bearing so as to permit radially outward movement of the shafts, and, in turn, the pinch wheels, with respect to the idler roller.

The inner edge or surface of the locking ring is formed with cam surfaces which engage the pinch wheel shaft bearing housings. There are three cam surfaces, one for each of the pinch wheels, and each cam surface terminates in an arcuate recess. The locking ring is rotatable with respect to the pinch wheels between a wire insertion position and a wire clamping position. In the wire insertion position, the locking ring is rotated so that the pinch wheel bearing housings seat within the arcuate recess of the cam surfaces. The spherical bearings at the opposite end of the pinch wheel shafts permit radially outward movement of the pinch wheels within the recesses so that a space is provided between the periphery of the idler roller and the pinch wheels to receive wire to be coiled. Once the wire is fed in place between the pinch wheels and idler roller, the locking ring is rotated in the opposite direction to a wire clamping position wherein the cam surfaces engage the pinch wheel bearing housings and force the pinch wheels into contact with the wire.

The radial position of the pinch wheels with respect to the idler roller must be controlled to accommodate wires of different diameter and also to provide the proper amount of traction which the pinch wheels exert on the wire to positively grip and advance the wire. Radial positioning of the pinch wheels is achieved by a locking assembly having a pair of locking arms. One of the locking arms is fixed to the platen, and the other locking arm is slidably mounted at one end within a channel formed in the fixed locking arm, and at the opposite end to the locking ring. The slidable locking arm is movable within the channel of the fixed locking arm, in response to rotation of the locking ring, until it engages the end of the channel in the fixed arm.

The locking ring is formed with a number of mounting bores spaced about its periphery at varying distances from the fixed arm. One end of sliding locking arm is adapted to mount within any one of these mounting bores. The position of the slidable locking arm along the locking ring, relative to the fixed locking arm, controls the extent of rotation permitted the locking ring before the slidable locking arm seats against one end of the channel in the fixed arm preventing further rotation of the locking ring. The location of the holes in the locking ring are chosen so that for each diameter wire, the locking ring is permitted to rotate to a position where its camming surfaces engage the pinch wheel bearing housings and move the pinch wheels against the idler roller with sufficient force to ensure secure clamping of the wire against the idler roller.

DESCRIPTION OF THE DRAWINGS

The structure, operation and advantages of a presently preferred embodiment of this invention will become further apparent upon consideration of the following description taken in conjunction with the accompanying drawings, wherein.

DETAILED DESCRIPTION OF THE INVENTION

Figure 1:
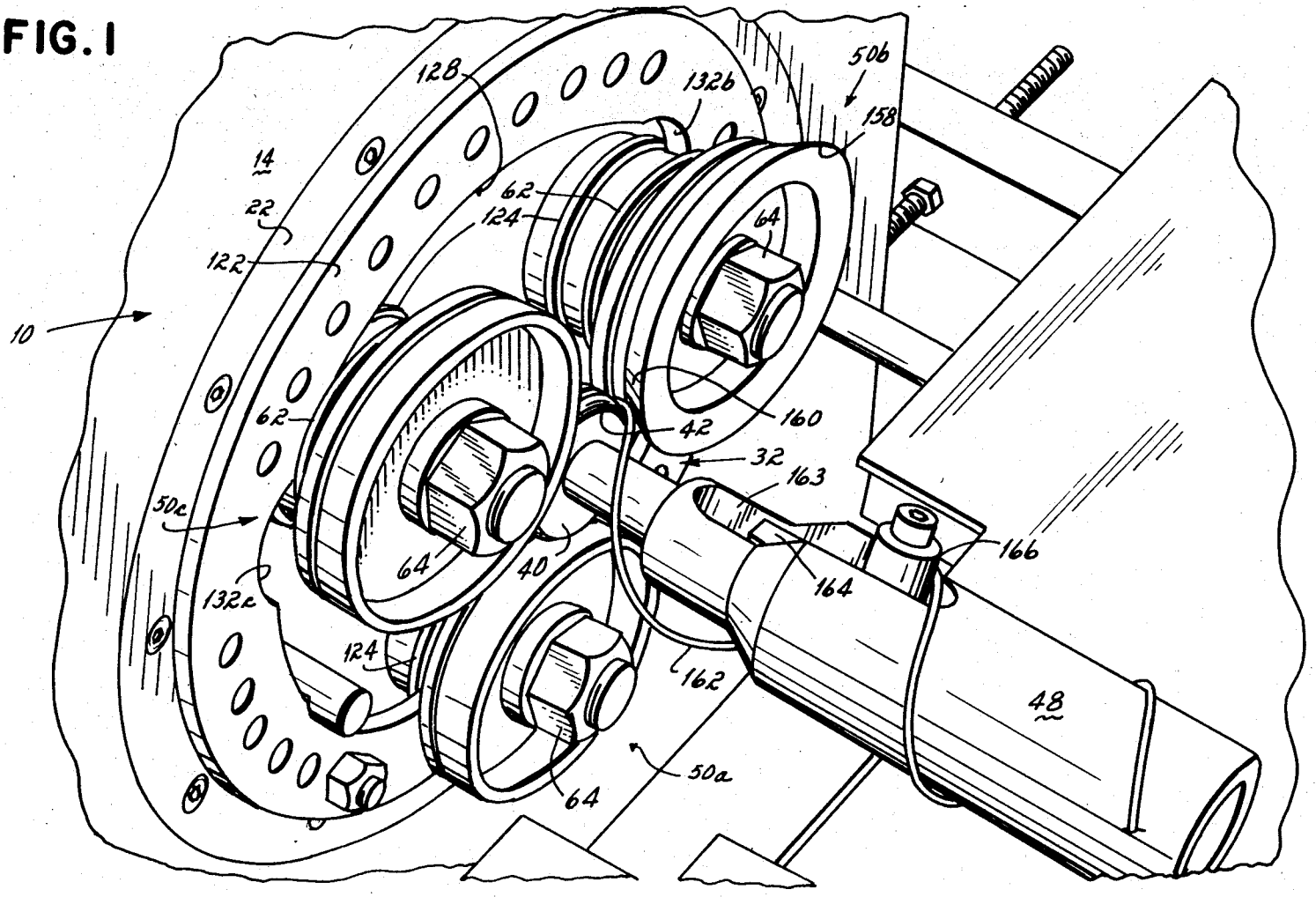
FIG. 1 is an isometric view of one side of the front portion of the coil-forming device of this invention showing the pitch adjustment roller and the coil-forming sizing wheel.

Referring now to the drawings, the coil-forming apparatus 10 of this invention includes a fixed frame 12 having a front plate 14, a rear plate 16 and interconnected top, bottom and side plates (not shown). As described in detail below, the frame 12 supports three wire gripping wheels which are mounted upon a platen movable in a planetary motion relative to an idler roller. Wire 15 is guided to the rotating platen and between the idler roller and three pinch wheels spaced about the periphery of the idler roller. The planetary movement of the platen relative to the idler roller imparts a twist to the wire 15 along its longitudinal axis. The wire 15 is drivingly advanced axially along the idler roller by the pinch wheels where it is formed into coils and thereafter set with the desired pitch.

The front plate 14 of the frame 12 is formed with an enlarged bore in which a bearing 20 is mounted. A platen 18 is carried by the bearing 20 for rotation with respect to the fixed front plate 14. The platen 18 may be provided with a cover plate 22 which is rotatable therewith. The platen 18 is rotatably driven by a planetary drive gear 24 which mates with a timing belt 26 driven by a motor (not shown).

Figure 3:
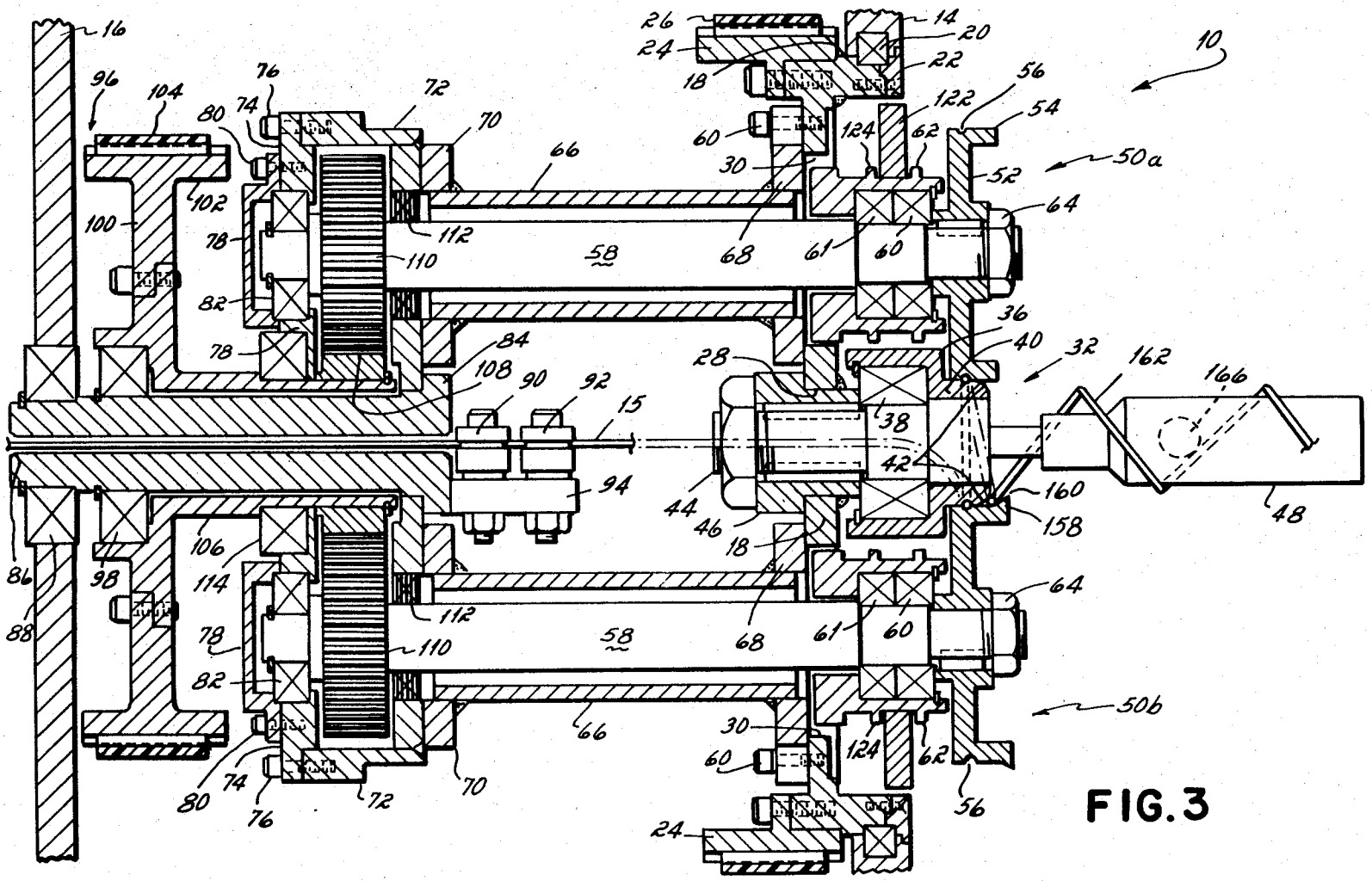
FIG. 3 is a cross sectional view taken generally along line 3—3 of FIG. 2 illustrating the drive arrangements and specific structure of the invention.

As best shown in FIG. 3, the platen 18 is a generally annular plate having a central bore 28 and three outer bores 30*a–c*, only two of which are shown in FIG. 3. The outer bores 30*a–c* are disposed radially outwardly from the central bore 28 and are spaced approximately 120° from each other.

Referring again to FIG. 3, the central bore 28 in the platen 18 receives an idler roller 32. The idler roller 32 includes a stepped annular housing having a larger diameter rearward section 36 carried by a bearing 38 and a smaller diameter, forward section 40 having a wire-receiving groove 41 and a tapered end 42. The bearing 38 is carried upon a shaft 44 which is mounted within a sleeve 46 welded or brazed to the platen 18. A mandrel 48, described in more detail below, is mounted co-axially with the idler roller 32 to its forward section 40. Since the rearward section 36 of idler roller 32 is mounted upon bearing 38, idler roller 32 is free-wheeling relative to the platen 18.

Figure 2:
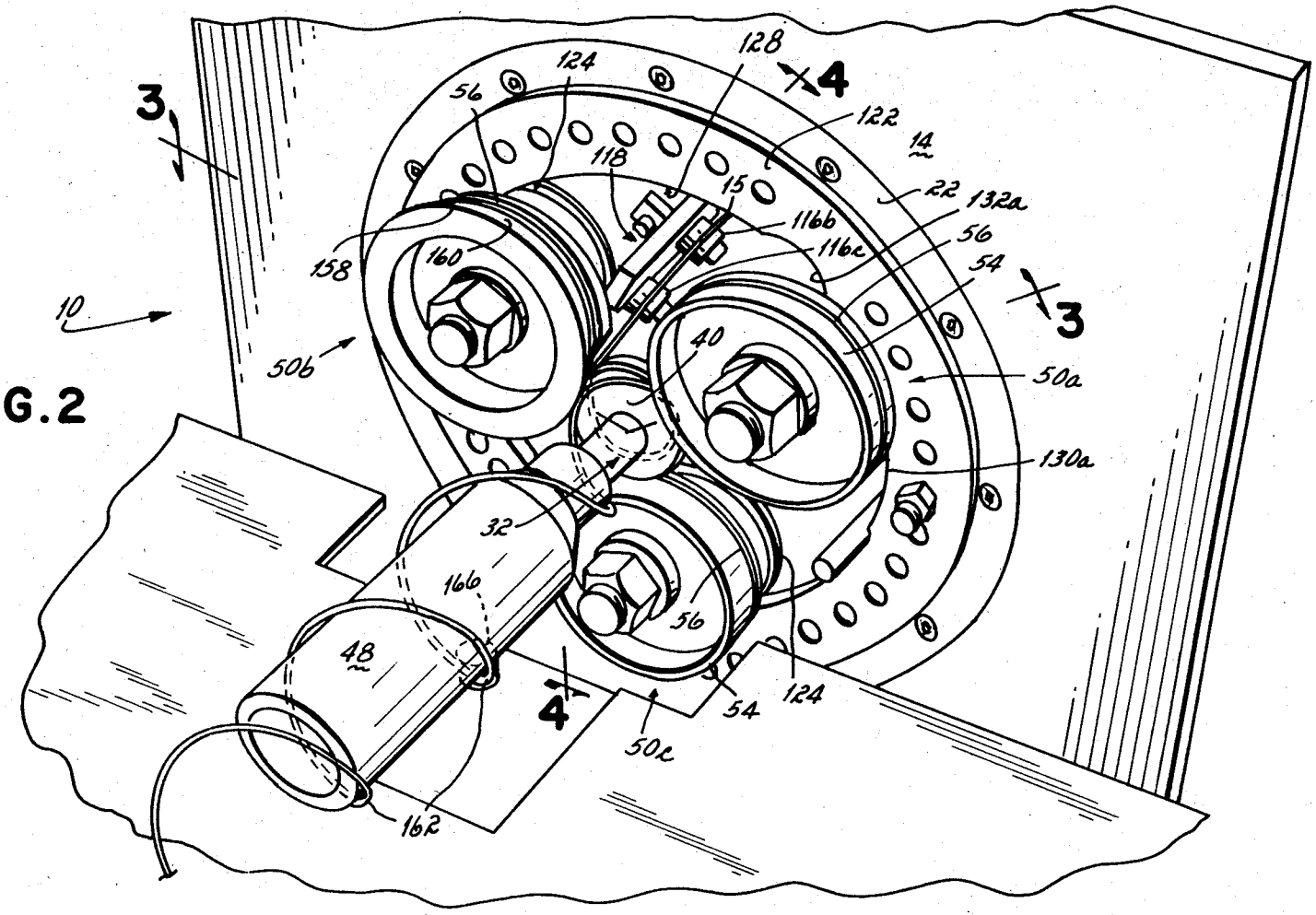
FIG. 2 is an isometric view of the front of the coil-forming device herein from the opposite side of FIG. 1 showing the wire being guided between the pinch wheels.

As illustrated in FIGS. 1 and 2, three pinch wheels 50*a–c* extend through the bores 30*a–c* in the platen 18, respectively, and are positioned at 120° intervals about the periphery of idler roller 32. The pinch wheels 50*a–c* have two primary functions. One function is to grip and controllably advance the wire through the coil-forming apparatus 10 to ensure the same length of wire 15 is used to form each coil. Another purpose of the pinch wheels 50*a–c* is to form coils of uniform diameter against the tapered end 42 of the idler roller 32.

Referring now to FIG. 3, the structure of pinch wheels 50*a* and 50*b* is illustrated in detail. For purposes of clarity, pinch wheel 50*c* is omitted from FIG. 3. Each pinch wheel 50*a–c* is essentially identical in configuration and therefore only pinch wheel 50*a* will be described in detail herein with like reference numerals being applied to the other pinch wheels 50*b* and 50*c*.

As shown at the top portion of FIG. 3, pinch wheel 50*a* comprises a generally annular plate 52 having a radially outwardly extending flange 54 formed with a circumferential, wire-receiving groove 56. The pinch wheel 50*a* is carried by a shaft 58 whose forward end is keyed to bearings 60, 61 mounted within a pinch wheel bearing housing 62. The pinch wheel 50*a* is mounted upon the shaft 58 by a nut 64.

The shaft 58 extends rearwardly from the pinch wheel 50*a* within a shaft housing 66 having a forward mounting flange 68 connected by a bolt 69 to the platen 18 and a rearward mounting flange 70 welded or brazed to an annular gear housing 72. The annular gear housing 72 includes an end cap 74 connected thereto by screws 76 and a cover plate 78 connected by screws 80 to the end cap 74. The cover plate 78 and end cap 74 mount a spherical bearing 82 which is keyed to the rearward end of the pinch wheel drive shaft 58. The spherical bearing 82 permits limited pivotal movement of the pinch wheel shaft 58, and in turn the pinch wheel 50*a*, within the shaft housing 66 for purposes to become apparent below.

In order for the pinch wheels 50*a–c* to positively advance the wire 15 through the coil-forming apparatus 10, they must be driven synchronously and independently of the planetary motion of the platen 18. The drive for the pinch wheel shaft 58 is illustrated at the lefthand portion of FIG. 3. A center shaft 84 having a throughbore 86 which receives the wire 15 is rotatably mounted upon the fixed rear plate 16 by a bearing 88. A pair of feed rollers 90, 92 carried by a mounting bracket 94 are mounted at the forward end of the center shaft 84 in alignment with its throughbore 86 to receive the wire 15 moving therethrough.

A shaft drive gear 96 is mounted upon a bearing 98 keyed to the center shaft 84. The shaft drive gear 96 comprises a generally annular plate portion 100 having an outer, annular flange 102 which mates with a timing belt 104 driven by a motor (not shown). An annular sleeve 106, connected to the annular plate portion 100 of shaft drive gear 96, extends forwardly therefrom concentric to center shaft 84. A drive gear 108 is mounted to the sleeve 106 at its forward end, and the drive gear 108 drivingly engages driven gears 110 mounted to the pinch wheel shafts 58 of pinch wheels 50*a–c*, respectively. Each driven gear 110 is rotatable within the gear housing 72, and is sealed by oil seals 112 at the forward end. The gear housing 72 is mounted upon the annular sleeve 106 of shaft drive gear 96 by a bearing 114.

Rotational movement of the pinch wheels 50*a–c* is therefore achieved as follows. The shaft drive gear 96 is rotatable upon bearing 98 relative to the center shaft 84 in response to movement of the timing belt 104. The drive gear 108 at the forward end of annular sleeve 106 drivingly rotates the driven gears 110 to rotate the pinch wheel shafts 58, and in turn, pinch wheels 50*a–c*. The gear housing 72 remains stationary relative to the shaft drive gear 96 because it is mounted thereto by bearing 114.

The entire pinch wheel drive assembly rotates with the planetary motion of platen 18. When the platen 18 is rotated by the planetary drive gear 24, the shaft housings 66 of each pinch wheel 50*a–c* rotate with the platen 18 because their forward mounting flanges 68 are fixed to the platen 18. Since the shaft housings 66 are connected at their rearward end to the gear housing 72, it too rotates with the platen 18. Rotation of the gear housing 72, in turn, rotates the center shaft 84 since it is connected at its forward end to the gear housing 72.

Figure 4:
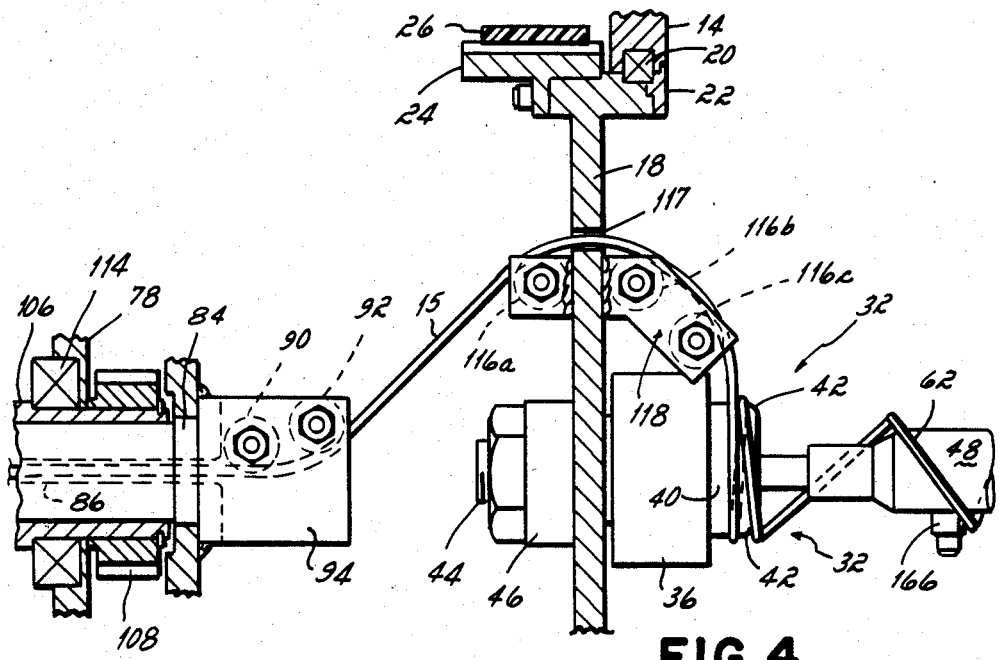
FIG. 4 is a schematic view in partial cross section taken generally along line 4—4 of FIG. 2 showing the guide rollers for guiding the wire between the pinch wheels and idler roller.

The wire 15 is guided through the center shaft 84 to the feed rollers 90, 92 mounted to bracket 94. The wire 15 is turned upwardly from the axis of center shaft 84 and directed radially outwardly through a bore 117 formed in platen 18 to a series of forward guide rollers 116*a–c* mounted upon a carriage 118 connected to platen 18. As shown in FIG. 4, the forward guide rollers 116*a–c* are oriented to receive the wire 15 at a point radially spaced from idler roller 32, and then to guide the wire 15 radially inwardly into the groove 56 of the pinch wheels 50*a–c* and groove 41 in the idler roller 32.

Considering first the twisting operation of the coil-forming apparatus 10 of this invention, reference is made to FIGS. 1–3. The wire 15 is directed from the rearward portion of the apparatus 10 to the guide rollers 116*a–c* mounted to platen 18 and is then gripped between the pinch wheels 50*a–c* and the forward section 40 of idler roller 32. The length of wire 15 between the idler roller 32 and guide rollers 116*a–c* at the platen 18 is twisted along its longitudinal axis as the platen 18 makes a single revolution relative to the idler roller 32. The twisting occurs because a portion of the wire 15 is clamped by the pinch wheels 50*a–c* against the idler roller 32, and another portion of the wire 15 is rotated by the platen 18 relative to the fixed portion of the wire 15. The twisted wire 15 is now ready for formation into coils along the idler roller 32, and in particular, on the tapered end 42 of idler roller 32 as described below.

In performing the coil-forming operation, the pinch wheels 50*a–c* also positively advance or move the wire 15 through the coil-forming apparatus 10. An important aspect of this invention is that the pinch wheels 50*a–c* are radially adjustable with respect to the idler roller 32 to positively control the traction or gripping force exerted against the wire 15 as it moves along the idler roller 32. The radial adjustment of the pinch wheels 50*a–c* also accommodates wires 15 of different diameter.

Figure 5:
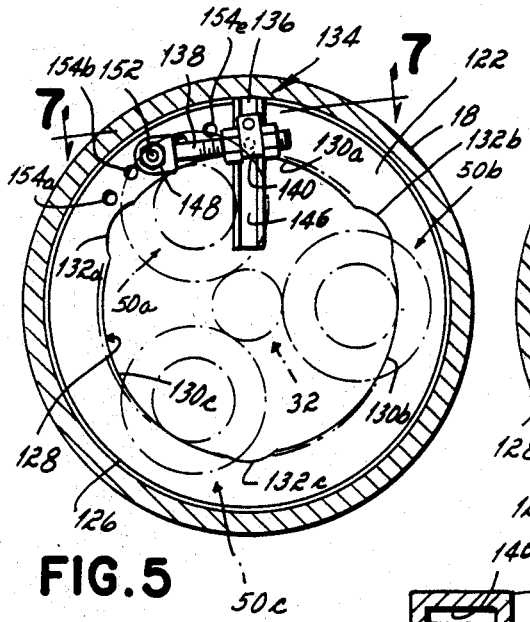
FIG. 5 is a rear elevational view of the locking ring including the locking assembly of this invention in a wire clamping position.
Figure 6:
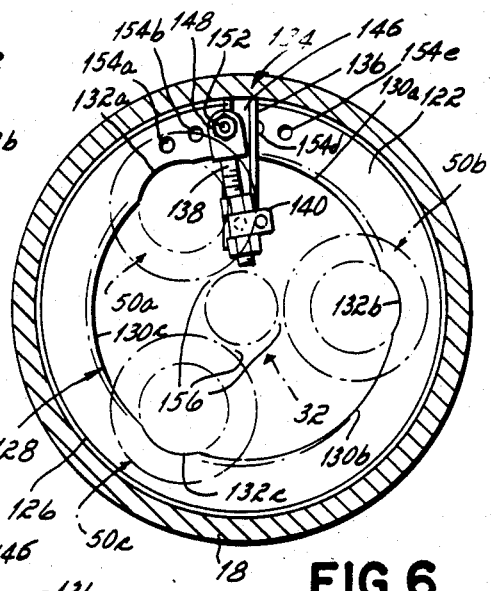
FIG. 6 is the locking assembly shown in FIG. 5 in the wire feeding position.

The radial adjustment feature of this invention is best illustrated in FIGS. 3, 5 and 6. A locking ring 122 seats within a groove 124 formed in each of the pinch wheel bearing housings 62. The locking ring 122 is in the form of a doughnut-shaped plate having an outer surface 126 and an inner surface 128. The inner surface 128 of locking ring 122 is formed with three cam surfaces 130*a–c* each of which terminates in a recess 132*a–c*, respectively. As viewed in FIG. 5, each of the cam surfaces 130*a–c* extends progressively further radially inwardly relative to the idler roller 32 moving from the recesses 132*a–c* clockwise about the inner surface 128 of locking ring 122.

Figure 7:
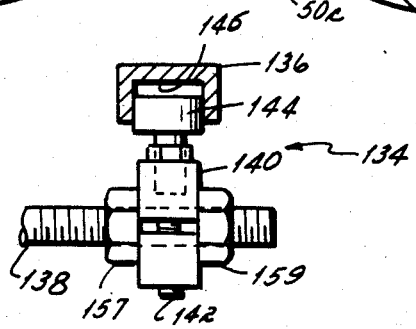
FIG. 7 is a partial view of the locking assembly herein taken generally along line 7—7 of FIG. 5.

The locking ring 122 is mounted to the platen 18 by a locking assembly 134. The locking assembly 134 comprises a fixed arm 136 mounted to the platen 18 and a slidable arm in the form of a threaded bolt 138 mounted between the fixed arm 136 and the locking ring 122. As shown in FIG. 7, one end of the bolt 138 is received within a split sleeve 140 which is secured to the bolt 138 by tightening a screw 142. A roller 144 extends outwardly from the split sleeve 140 and is received within a longitudinal slot or channel 146 formed along the length of the fixed arm 136. The opposite end of the bolt 138 is mounted to a head 148 formed with a throughbore which receives a threaded stud 152. The stud 152 is insertable within any one of a number of spaced bores 154*a–e* formed in the locking ring 122. The purpose of the locking assembly 134 is to control the extent of rotation of the locking ring 122 relative to the pinch wheel bearing housings 62, and also to maintain the locking ring 122 in place during a coiling operation.

Radial adjustment of the pinch wheels 50*a–c* is achieved as follows. Initially, as shown in FIG. 6, the locking ring 122 is rotated in a clockwise direction relative to the pinch wheels 50*a–c* to a wire-receiving or feeding position wherein the pinch wheel bearing housings 62 seat within the recesses 132*a–c* formed in the inner surface 128 of locking ring 122. As discussed above, the pinch wheel shafts 58 are carried by a spherical bearing 82 at their rearward ends and are biased by a spring (not shown) to permit radial movement of the pinch wheels 50*a–c* within their shaft housings 66. Therefore, upon alignment of the recesses 132*a–c* with the pinch wheel bearing housings 62, the pinch wheels 50*a–c* move radially outwardly leaving a gap 156 between them and the idler roller 32. As illustrated in FIG. 6, the roller 144 connected to the threaded bolt 138 slides along the channel 146 in the fixed arm 136 so that the bolt 138 is nearly co-linear with the fixed arm 136. With the pinch wheels 50*a–c* in a radially outward or open position, the wire 15 may be readily placed between the wire-receiving groove 41 formed in the forward section 40 of idler roller 32, and the grooves 56 formed in pinch wheels 50*a–c*.

The pinch wheels 50*a–c* are moved radially inwardly toward the idler roller 32 by rotating the locking ring 122 in the opposite, counterclockwise direction so that the cam surfaces 130*a–c* engage the pinch wheel bearing housings 62 of pinch wheels 50*a–c*, respectively. The extent of counterclockwise rotation of locking ring 122 is controlled by the position at which the bolt 138 of locking assembly 134 mounts to the locking ring 122. The extent of rotation of locking ring 122 is chosen according to the diameter of the wire 15 to be coiled.

For example, assume that a relatively large diameter wire 15 is to be coiled. In this instance, the threaded bolt 138 of locking assembly 134 is mounted to one of the bores 150*a–e* closest to the recess 132*a*, such as bore 150*a*. This would limit the counterclockwise rotation of locking ring 122 permitted before the threaded bolt 138 travels along the length of the fixed arm 136 to a locked position at the top of channel 144 as shown in FIG. 5. As mentioned above, the radial space between the idler roller 32 and cam surfaces 130*a–c* is greatest near the recesses 132*a–c* and then progressively decreases moving clockwise along the locking ring 122 from the recesses 132*a–c*. Therefore, as the locking ring 122 is rotated counterclockwise, the pinch wheels 50*a–c* are moved progressively radially inwardly toward the idler roller 32. For large wires, such radial inward movement must be limited and therefore the threaded bolt 138 is mounted to a bore 150*a* in the locking ring closer to the recesses 132*a–c* to limit such counterclockwise rotation. In contrast, small diameter wires would require threaded bolt 138 to be mounted within one of the bores 150*d* or 150*e* so as to permit more counterclockwise rotation of locking ring 122 and thus greater radial inward movement of the pinch wheels 50*a–c*.

For each diameter wire accommodated by the locking ring 122, the position of the bores 154*a–e* is chosen to control the extent of counterclockwise rotation of locking ring 122 so that the pinch wheels 50*a–c* are forced against the wire 15 with the proper force to ensure positive and controlled movement of the wire 15. A pair of adjustment nuts 157, 159 are provided on the threaded bolt 138 to adjust the position of bolt 138 relative to fixed arm 136 which, in turn, provides a fine adjustment of the traction exerted by the pinch wheels 50*a–c* on the wire 15. Such adjustment is usually not necessary, but is provided to ensure proper traction is always maintained on the wire 15.

Referring now to FIGS. 1–3, the coiling operation proceeds as follows. In a presently preferred embodiment of this invention, pinch wheel 50*b* is provided with a sizing attachment or wheel 158 which is mounted at its forward end. The sizing wheel 158 is formed with a tapered surface 160 which increases in cross section from the forward end of pinch wheel 50*b* forwardly toward the mandrel 48. The tapered surface 160 of sizing wheel 158 is shaped to engage and bend the wire 15 at the tapered end 42 of idler roller 32 to form the finished diameter of a coil 162. The diameter of each coil 162 can be varied by changing the taper or angle of tapered surface 160, or by changing the axial position of the sizing wheel 158 upon pinch wheel 50*b* with a threaded adjustment (not shown), so that the wire 15 is bent at a different location along the tapered end 42 of idler roller 32, thus altering the diameter of the coil 162. For example, if the sizing wheel 158 engages the tapered surface 42 of the idler roller 32 near the forwardmost portion of the tapered surface 42, the diameter of the coil 162 would be less than that if the sizing wheel 158 engaged the tapered surface 42 rearwardly where it has a larger diameter.

After formation of the coils by the sizing wheel 158, each coil 162 continues moving axially from the idler roller 32 to the mandrel 48 mounted coaxially to the idler roller 32. In a presently preferred embodiment, the mandrel 48 is formed with a slot 163 which receives a pitch adjustment carriage 164 axially movable therein. The pitch adjustment carriage 164 supports a roller 166 in a position to engage the coil 162 as it moves from the idler roller 32. The pitch adjustment carriage 164, and in turn roller 166, are axially movable along the mandrel 48 so as to vary the axial distance between the roller 166 and idler roller 32. Engagement of the roller 166 with each coil 162 sets a pitch in the coil 162 which is dependent upon the axial spacing between the roller 166 and idler roller 32.

OPERATION

The coil-forming apparatus 10 of this invention operates in the following manner. Wire 15 from a spool or reel (not shown) is guided through the center shaft 84 to feed rollers 90, 92 and then radially outwardly through the platen 18 to forward guide rollers 116*a–c*. The wire 15 is directed radially inwardly from the guide rollers 116 between the pinch wheels 50*a–c* and the idler roller 32. One revolution of the platen 18 with respect to the idler roller 32 imparts a twist along the longitudinal axis of the wire 15 extending between the platen 18, and the pinch wheels 50*a–c* and idler roller 32.

The wire 15, now twisted, is gripped between the rotating pinch wheels 50*a–c* and the free-wheeling idler roller 32 within their wire-receiving grooves 56, 41, respectively. The radial position of the pinch wheels 50*a–c* with respect to the idler roller 32 is adjusted to accommodate the diameter of wire 15, and also to ensure that the wire 15 is pinched with sufficient traction to positively advance the wire 15 along the idler roller 32. The wire 15 is pre-formed in the shape of a coil within the groove 41 formed in the forward section 40 of idler roller 32 and the grooves 56 in pinch wheels 50*a–c*.

As the pinch wheels 50*a–c* continue to rotate the wire 15 is moved outwardly from the groove 41, and into engagement with the sizing wheel 158 mounted to pinch wheel 50*b*. The sizing wheel 158 bends the wire 15 against the tapered end 42 of the idler roller 32 to form a coil 162 with the desired, final diameter. The now-coiled wire 15 moves axially from idler roller 32 and engages the adjustable pitch roller 166 of the mandrel 48 to set the coil 162 with the desired pitch. Each coil 162 then continues its axial movement, without rotation, for further handling.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

What is claimed is:

1. Apparatus for coiling wire comprising:

an idler roller having a tapered, forward surface;

a plurality of pinch wheels spaced about the periphery of said idler roller;

guide means for guiding wire between said pinch wheels and said idler roller;

means for longitudinally twisting the wire guided between said pinch wheels and said idler roller to form twisted wire;

said pinch wheels positively clamping said twisted wire against said idler roller, said pinch wheels being rotatable relative to said idler roller for drivingly advancing said twisted wire along said idler roller, at least one of said pinch wheels bending said twisted wire against said tapered surface of said idler roller to form coils.

2. The apparatus of claim 1 in which said guide means comprises a plurality of feed rollers, at least one of said feed rollers being radially spaced from the longitudinal axis of said idler roller, the wire being guided radially inwardly from said feed roller between said idler roller and said pinch rollers.

3. The apparatus of claim 1 in which each of said pinch wheels is formed with a circumferential groove in alignment with a circumferential groove formed in said idler roller, the wire being fed into said aligning circumferential grooves of said pinch wheels and said idler roller for positive clamping of the wire against said idler roller.

4. The apparatus of claim 1 in which said means for twisting the wire comprises a platen rotatable with respect to said idler roller, the wire being fed by said guide means to said platen and then between said pinch wheels and said idler roller, the wire being twisted upon rotation of said platen relative to said idler roller.

5. Apparatus for coiling wire comprising:

a rotatable platen;

an idler roller rotatably mounted to said platen, said idler roller being formed with a tapered end portion;

a plurality of pinch wheels mounted to said platen, said pinch wheels being spaced about the periphery of said idler roller;

guide means for guiding the wire between said pinch wheels and said idler roller;

said pinch wheels being rotatable relative to said idler roller for drivingly engaging the wire to advance the wire along said idler roller;

sizing means connected to at least one of said pinch wheels for bending the wire at a predetermined point along said tapered end portion of said idler roller to form a coil of selected diameter.

6. The apparatus of claim 5 in which said sizing means comprises a tapered sizing wheel connected to one of said pinch wheels, said tapered sizing wheel being formed to engage said tapered end portion of said idler roller at a predetermined position to bend the wire at said predetermined position and form a coil in the wire of selected diameter.

7. Apparatus for coiling wire comprising:

a platen rotatable about a longitudinal axis;

an idler roller mounted to said platen for rotation about said longitudinal axis, said idler roller being formed with a tapered end portion;

a plurality of pinch wheels rotatably mounted to said platen, said pinch wheels being radially spaced from said longitudinal axis about the periphery of said idler roller;

guide means for guiding the wire through said platen and between said pinch wheels and said idler roller at a location radially spaced from said longitudinal axis of said platen;

said pinch wheels being rotatable relative to said idler roller for drivingly engaging the wire to advance the wire along said idler roller;

sizing means connected to at least one of said pinch wheels for bending the wire at a predetermined point along said tapered end portion of said idler roller to form a coil of selected diameter.

8. The apparatus of claim 7 wherein said idler roller and said pinch wheels are mounted upon the front side of said platen, said guide means being operable to guide the wire along said longitudinal axis of said platen from the rear side of said platen, through said platen at a location radially spaced from said longitudinal axis of said platen to the front side of said platen between said pinch wheels and said idler roller so as to impart a longitudinal twist to the wire during rotation of said platen.

9. Apparatus for coiling wire comprising:

an idler roller;

a plurality of pinch wheels spaced about the periphery of said idler roller;

guide means for guiding wire between said pinch wheels and said idler roller;

means for longitudinally twisting the wire guided between said pinch wheels and said idler roller to form twisted wire;

said pinch wheels positively clamping said twisted wire against said idler roller, said pinch wheels being rotatable relative to said idler roller for drivingly advancing said twisted wire along said idler roller, at least one of said pinch wheels bending said twisted wire against said idler roller to form coils;

a mandrel mounted to said idler roller;

pitch adjustment means carried by said mandrel for engaging said coils from said idler roller and forming said coils with a predetermined pitch.

10. The apparatus of claim 9 in which said pitch adjustment means comprises:

a carriage axially movable along a slot formed in said mandrel;

a roller rotatably mounted upon said carriage, said roller engaging said coils moving from said idler roller to form said coils with a predetermined pitch.

11. Apparatus for coiling wire comprising:

a rotatable platen;

an idler roller rotatably mounted to said platen;

a plurality of pinch wheels mounted to said platen and being spaced about the periphery of said idler roller, said pinch wheels being rotatable relative to said idler roller;

guide means for guiding wire between said pinch wheels and said idler roller;

a locking ring carried by said pinch wheels and rotatable relative thereto, said locking ring having an inner edge formed with a cam surface for each of said pinch wheels, said cam surfaces each being engageable with one of said pinch wheels for varying the radial position of said pinch wheels relative to said idler roller;

a locking assembly including a first arm fixed to said platen and a second arm having one end movably mounted to said first arm, the other end of said second arm being mounted in a selected position to said locking ring;

said locking assembly controlling the extent of rotation of said locking ring relative to said pinch wheels so that said pinch wheels engage said inner edge of said locking ring at a predetermined location along said cam surfaces, the location of said pinch wheels along said cam surfaces determining the radial position of said pinch wheels relative to said idler roller and the wire therebetween.

12. The apparatus of claim 11 in which said first arm of said locking assembly is formed with an elongated channel, said second arm having a roller movable within said channel upon rotation of said locking ring.

13. The apparatus of claim 11 in which said locking ring is formed with a plurality of spaced bores located a varying distance from said fixed arm, said second arm of said locking assembly being adapted to mount within each of said spaced bores, said locking ring being permitted to rotate to a greater extent upon mounting said second arm to one of said bores in said locking ring close to said fixed arm, and said locking ring being permitted to rotate to a lesser extent upon mounting said second arm to one of said bores in said locking ring further away from said fixed arm, the greater the rotation of said locking ring the greater the radial inward movement of said pinch wheels relative to said idler roller.

14. The method of forming a coil with a coil forming machine which includes three pinch wheels spaced about the periphery of an idler roller for rotation about the longitudinal axis of a rotatable platen, which method comprises:

feeding the wire through said platen at a location radially spaced from said longitudinal axis of said platen and between said pinch wheels and idler roller while rotating said platen relative to said idler roller so as to impart a longitudinal twist to the wire; and drivingly engaging the twisted wire with a controlled gripping force between said pinch wheels and said idler roller against a tapered forward surface of said roller to form the wire into coils of selected diameter.

15. The method of claim 14 further including advancing the coil wire forwardly from between said pinch wheels and said tapered, forward surface of said idler roller.

16. Apparatus for helically coiling wire comprising:

a platen having a forward side and a rearward side, said platen being rotatable about a platen axis, an idler roller mounted upon the forward side of said platen, said idler roller being rotatable relative to said platen, a plurality of pinch wheels mounted upon the forward side of said platen, said pinch wheels being spaced about the periphery of said idler roller;

guide means mounted upon said platen for guiding wire between said pinch wheels and said idler roller;

means for feeding wire from the rearward side of said platen through said platen to the forward side of said platen, said wire being fed through said platen at a location on said platen radially offset from the axis of said platen so as to longitudinally twist the wire and create twisted wire before the wire is guided between said pinch wheels and said idler roller, and said pinch wheels positively clamping said twisted wire against said idler roller, said pinch wheels being rotatable relative to said idler roller for drivingly advancing said twisted wire along said idler roller, at least one of said pinch wheels bending said twisted wire against said idler roller to form helical coils.

17. The apparatus of claim 16 in which said guide means comprises a plurality of feed rollers, at least one of said feed rollers being radially spaced from the longitudinal axis of said idler roller, the wire being guided radially inwardly from said feed roller between said idler roller and said pinch rollers.

18. The apparatus of claim 16 in which each of said pinch wheels is formed with a circumferential groove in alignment with a circumferential groove formed in said idler roller, the wire being fed into said aligning circumferential grooves of said pinch wheels and said idler roller for positive clamping of the wire against said idler roller.

* * * * *